US005822884A

United States Patent [19]

Roeder

[11] Patent Number: 5,822,884

[45] Date of Patent: Oct. 20, 1998

[54] SLIP-RESISTANT SHOE COVER

[75] Inventor: Robert J. Roeder, Roswell, Ga.

[73] Assignee: Kimberly-Clark Worldwide, Inc., Neenah, Wis.

[21] Appl. No.: 678,262

[22] Filed: Jul. 11, 1996

[51] Int. Cl.[6] ..... A43B 3/16; A43B 23/28

[52] U.S. Cl. ..... 36/7.1 R; 36/59 C

[58] Field of Search ..... 36/7.1 R, 9 R, 36/7.7, 7.6, 9 A, 59 C

[56] References Cited

U.S. PATENT DOCUMENTS

| | | | |
|---|---|---|---|
| 2,700,161 | 1/1955 | Boyce | 2/240 |
| 2,710,366 | 6/1955 | Stern, Jr. et al. | 361/224 |
| 3,311,937 | 4/1967 | Conroy | 12/142 |
| 3,338,992 | 8/1967 | Kinney | 264/24 |
| 3,341,394 | 9/1967 | Kinney | 161/72 |
| 3,349,285 | 10/1967 | Belkin | 128/132 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,828,367 | 8/1974 | Bourgeois | 2/224 |
| 3,849,241 | 11/1974 | Butin et al. | 161/169 |
| 3,863,272 | 2/1975 | Guille | 2/239 |
| 3,898,750 | 8/1975 | Epstein | 36/49 |
| 3,909,009 | 9/1975 | Cvetko et al. | 274/37 |
| 3,981,088 | 9/1976 | Mitchell et al. | 36/87 |
| 4,019,265 | 4/1977 | Epstein | 36/7.1 R |
| 4,022,456 | 5/1977 | Hooper et al. | 270/65 |
| 4,041,203 | 8/1977 | Brock et al. | 428/157 |
| 4,069,515 | 1/1978 | Swallow | 2/239 |
| 4,081,301 | 3/1978 | Buell | 156/164 |
| 4,083,124 | 4/1978 | Michalak | 36/7.1 R |
| 4,194,308 | 3/1980 | Karlsson | 36/9 R |
| 4,224,935 | 9/1980 | Metelnick | 36/7.1 R X |
| 4,272,859 | 6/1981 | Vanhove | 12/142 K |
| 4,296,499 | 10/1981 | Patterson et al. | 2/239 |
| 4,307,143 | 12/1981 | Meitner | 252/91 |
| 4,340,563 | 7/1982 | Appel et al. | 264/518 |

(List continued on next page.)

FOREIGN PATENT DOCUMENTS

| | | | |
|---|---|---|---|
| 648155 | 10/1992 | Australia | 36/7.1 R |
| 833178 | 9/1975 | France . | |
| 880157 | 11/1979 | France . | |
| 2575044 | 6/1986 | France . | |
| 2619998 | 3/1989 | France | 36/7.1 R |
| 2672779 | 8/1992 | France . | |
| 2692114 | 12/1993 | France | 36/9 R |
| 1463863 | 2/1977 | United Kingdom . | |
| 1520653 | 9/1978 | United Kingdom . | |
| 2035047 | 6/1980 | United Kingdom . | |
| 2112268 | 7/1983 | United Kingdom . | |
| 2124472 | 2/1984 | United Kingdom . | |
| 91/04682 | 4/1991 | WIPO . | |
| 91/09545 | 7/1991 | WIPO | 2/51 |

OTHER PUBLICATIONS

Abstract for FR 833,178 (PN=FR 2,294,660) dated Mar. 8, 1976.

Abstract for FR 880,157 (PN=US 4,272,859) dated Mar. 17, 1980.

Abstract for FR 2,575,044 (PN=FR 2,575,044) dated Jun. 27, 1986.

Standard Test Method for Static and Kinetic Coefficients of Friction of Plastic Film and Sheeting, Designation: D 1894–78 (Reapproved 1986), pp. 175–179.

*Primary Examiner*—B. Dayoan
*Attorney, Agent, or Firm*—Nancy M. Klembus; David J. Alexander

[57] ABSTRACT

A disposable, flexible shoe cover for receive a sole of a shoe or a foot is provided. The shoe cover includes cleats secured to an outside surface of the shoe cover, wherein some of the cleats are adapted to overlie the sole. The cleats may include a first portion and a second portion wherein, the second portion is thicker in cross-section than the first portion. The first and second portions of the cleats may eccentricly positioned. The shoe cover may also include elastic member secured to an inside surface of the body and adapted to contact the sole.

15 Claims, 6 Drawing Sheets

U.S. PATENT DOCUMENTS

| | | | |
|---|---|---|---|
| 4,374,888 | 2/1983 | Bornslaeger | 428/198 |
| 4,427,408 | 1/1984 | Karami et al. | 604/393 |
| 4,516,336 | 5/1985 | Nissenbaum | 36/7.1 R |
| 4,598,485 | 7/1986 | Joe et al. | 36/7.7 X |
| 4,599,812 | 7/1986 | Harmsen | 36/1.5 |
| 4,610,042 | 9/1986 | Theodorsen | 36/7.1 R X |
| 4,616,428 | 10/1986 | Leger | 36/7.1 R |
| 4,616,429 | 10/1986 | Alcala | 36/7.2 |
| 4,651,354 | 3/1987 | Petrey | 36/9 R X |
| 4,663,220 | 5/1987 | Wisneski et al. | 428/221 |
| 4,769,928 | 9/1988 | Ward | 36/32 R X |
| 4,825,564 | 5/1989 | Sorce | 36/7.1 R X |
| 4,842,666 | 6/1989 | Werenicz | 156/161 |
| 4,847,934 | 7/1989 | Weber | 12/142 R |
| 4,918,839 | 4/1990 | Brandon | 36/7.1 R |
| 5,048,126 | 9/1991 | McLaughlin | 2/125 |
| 5,083,557 | 1/1992 | Lennon et al. | 128/82 |
| 5,133,088 | 7/1992 | Dunlap | 2/241 |
| 5,165,979 | 11/1992 | Watkins et al. | 428/113 |
| 5,169,706 | 12/1992 | Collier, IV et al. | 428/152 |
| 5,204,174 | 4/1993 | Daponte et al. | 428/286 |
| 5,213,881 | 5/1993 | Timmons et al. | 428/224 |
| 5,218,723 | 6/1993 | McLaughlin | 2/243 |
| 5,228,215 | 7/1993 | Bayer | 36/7.7 |

SLIP-RESISTANT SHOE COVER

FIELD OF THE INVENTION

The present invention is directed shoe covers and more particularly, the present invention is directed to slip-resistant shoe covers formed from nonwoven fabrics.

BACKGROUND OF THE INVENTION

As is generally known, protective garments, such as surgical gowns, surgical drapes, and shoe covers (hereinafter collectively "surgical articles") have been designed to greatly reduce, if not prevent, the transmission through the surgical article of liquids and/or airborne contaminants. In surgical procedure environments, such liquid sources include the gown wearer's perspiration, patient liquids, such as blood and life support liquids such as plasma and saline. Examples of airborne contaminants include, but are not limited to, biological contaminants, such as bacteria, viruses and fungal spores. Such contaminants may also include particulate material such as, but not limited to, lint, mineral fines, dust, skin squamae and respiratory droplets.

Many of these surgical articles were originally made of cotton or linen and were sterilized prior to their use in the operating room. In many instances, surgical articles fashioned from cotton or linen provide insufficient barrier protection from the transmission therethrough of airborne contaminants. Furthermore, these articles were costly, and, of course, laundering and sterilization procedures were required before reuse.

Disposable surgical articles, which also may require sterilization prior to their use, have largely replaced linen surgical articles. In some instances, such disposable surgical articles may be formed from nonwoven porous materials such as spunbonded polypropylene or nonwoven laminates, such as spunbond/meltblown/spunbond.

Some surgical articles, such as surgical gowns and drapes, are generally designed to loosely fit or overly the wearer. While surgical gowns and drapes are subjected to some pulling forces relative to the movement of the wearer, such gown and drapes generally are not subjected to the load bearing forces or abrupt pulling or shearing forces to which more form fitting surgical articles, such as shoe covers, may be subjected. As such, one challenge for the designers of form fitting surgical articles, such as shoe covers, is to sufficiently secure the seams in the fabric forming these articles such that these articles may withstand such load bearing, pulling and/or shearing forces. Furthermore, in the case of form fitting surgical articles, the designer thereof is further challenged to design effective, low-cost disposable surgical articles with forming fitting features.

Additionally, in the case of shoe covers, it is not uncommon for the operating room floor or hospital floors, which are generally smooth by design, to become insulted with the above described liquids which may be generated during a surgical procedure. As such, shoe cover designers are also challenged to design cost effective slip-resistant shoe covers.

Therefore, there is a need for shoe covers and methods for making the same which provide improved fabric bonding, form fitting and slip-resistant features. Such improved materials and methods are provided by the present invention and will become more apparent upon further review of the following specification.

SUMMARY OF THE INVENTION

In response to the above problems encountered by those of skill in the art, the present invention provides a disposable, flexible shoe cover for receiving a sole of a shoe or a foot. The shoe cover includes cleats secured to at least one surface of the shoe cover, wherein some of the cleats are adapted to overlie the sole. The shoe cover may also include an elastic member secured to an inside surface thereof, wherein said elastic member is adapted to contact the sole.

In one embodiment, the cleats may include a first portion and a second portion wherein, the second portion is thicker in cross-section than the first portion. In another embodiment, the first and second portions of the cleats are eccentricly positioned.

In another embodiment, the shoe cover may include a pair of panels. The panels are secured together near an area defined by respective top and side edges with a pressure sensitive hot melt adhesive. Additionally, portions of the respective side edges between the pressure sensitive hot melt adhesive and a bottom edge may be secured together by ultrasonic bonding. This shoe cover may further include an elastic member ultrasonically bonded to each panel near the top edge thereof and another elastic member secured near the bottom edge of one of the panels. Cleats may also be secured to at least one surface of the shoe cover, wherein some of the cleats are adapted to overlie the sole. These cleats may include a first portion and a second portion wherein the second portion is thicker in cross-section than the first portion. The first and second portions may also be eccentricly positioned.

DETAILED DESCRIPTION OF THE INVENTION

As used herein, the term "nonwoven fabric" refers to a fabric that has a structure of individual fibers or filaments which are interlaid, but not in an identifiable repeating manner.

As used herein the term "spunbond fibers" refers to fibers which are formed by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. Nos. 3,502,763 and 3,909,009 to Levy, and U.S. Pat. No. 3,542,615 to Dobo et al which are all herein incorporated by reference.

As used herein the term "meltblown fibers" means fibers formed by extruding a molten thermoplastic material through a plurality of fine, usually circular, die capillaries as molten threads or filaments into a high velocity, usually heated gas (e.g. air) stream which attenuates the filaments of molten thermoplastic material to reduce their diameter. Thereafter, the meltblown fibers are carried by the high velocity gas stream and are deposited on a collecting surface to form a fabric of randomly disbursed meltblown fibers. Meltblowing is described, for example, in U.S. Pat. No. 3,849,241 to Buntin, U.S. Pat. No. 4,307,143 to Meitner et al., and U.S. Pat. No. 4,663,220 to Wisneski et al which are all herein incorporated by reference.

Figure 1:
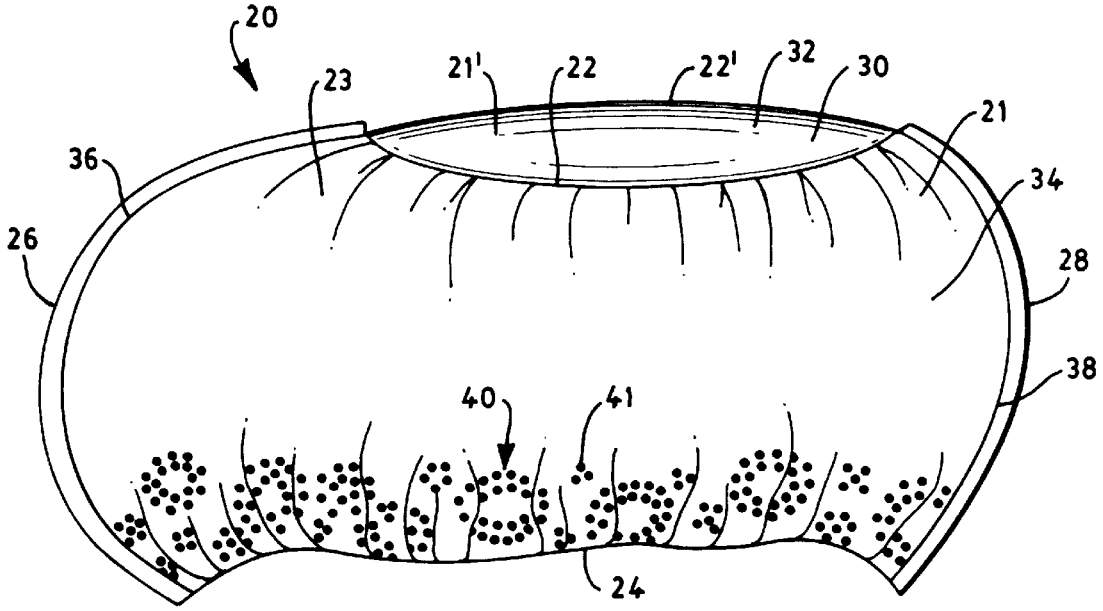
FIG. 1 is a side plan view of the shoe cover of the present invention.

Turning now to the drawings, FIG. 1 illustrates a shoe cover 20. The shoe cover 20 includes a body 23 formed by a pair of panels 21 and 21'. The panels 21 and 21' include a top edge 22 and 22', respectively. The top edges 22 and 22' define an opening 30 for receiving a sole (not shown) of a foot or a shoe. The panels 21 and 21' are joined along a common bottom edge 24 and side edges 26 and 28. Each panel 21 and 21' includes an inside surface 32 and an outside surface 34.

The top edges 22 and 22' each include a strip of elastic material described in greater detail below. In this way, the opening 30 is expandable so as to be forming fitting about the wearer's ankle. The bottom edge 24 is also made expandable by securing another strip of elastic material near the bottom edge 24. In this way, the shoe cover 20 fits snugly about the toe and heel portions of the sole. The shoe cover 20 further includes seams 36 and 38 near the side edges 26 and 28, respectively, formed by, for example, ultrasonic bonding the respective portions of the panels 21 and 21'.

A traction pattern 40, formed by a plurality of cleats 41, (described in greater detail below) is applied, such as by printing, to the outer surface 34 of the shoe cover 20 near the bottom edge 24. Desirably, the traction pattern 40 may be applied to one or both panels, 21 and 21', generally near bottom edge 24. So that sufficient tractional forces may be formed between the operating room floor and the outside surface 34 of the shoe cover 20, the width and length dimensions of the traction pattern 40 should be sufficient to overly a sufficient portion of the sole (not shown) of either the wearer's foot or shoe when the shoe cover 20 is worn. When the seams 36 and 38 are formed by ultrasonic bonding, it is desirable that the traction pattern 40 not extend into the area of the shoe cover 20 defined by seams 36 or 38.

Similarly, so that sufficient tractional forces may be formed between the inside surface 32 of the shoe cover 20 and the sole (not shown) of either the wearer's foot or shoe, a traction pattern 40' (FIG. 2) may be applied to the inside surface 32 of panels 21 and/or 21' near the bottom edge 24. The traction pattern applied to the inside surface 32 may be similar to the traction pattern 40 which is applied to the outside surface 34.

Figure 2:
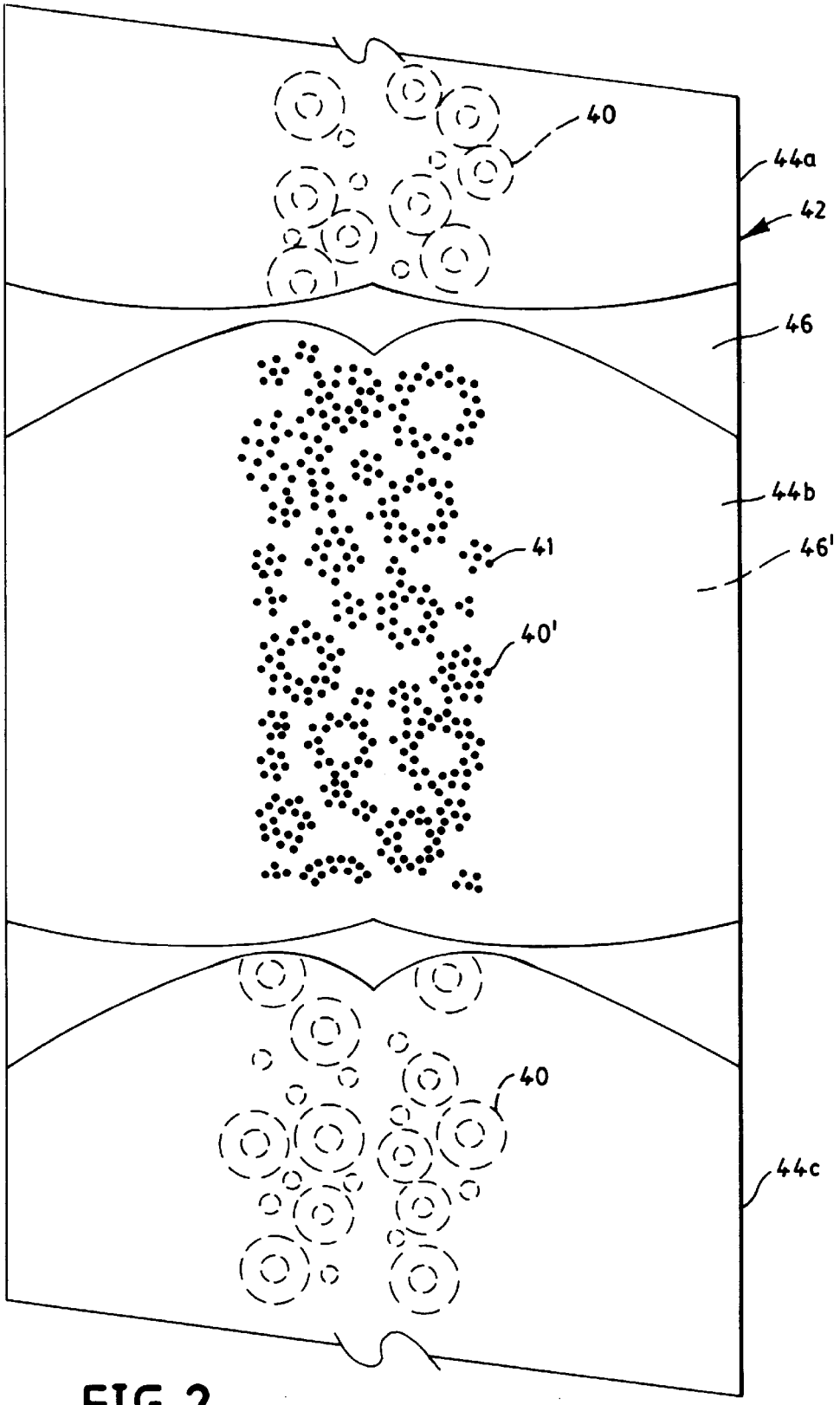
FIG. 2 is a plan view of a continuous sheet of material illustrating a plurality of shoe cover cut-out patterns overlaid by a repeating cleat pattern.

FIGS. 2–8 illustrate several process steps for forming the shoe cover 20 from a sheet of material 42, which may be a continuous sheet of material, having sides 46 and 46'. Referring now to FIG. 2, the sheet of material 42, suitable for making the shoe cover 20, is provided with repeating shoe cover cut-out patterns 44*a*, 44*b* and 44*c*. The side 46 of the material 42 will ultimately form the inside surface 32 of the shoe cover 20. As such, the traction pattern 40' on the side 46 of shoe cover cut-out pattern 44*b* will ultimately reside on the inside surface 32 of the shoe cover 20. Furthermore, the traction pattern 40 on the side 46' of the shoe cover cut-out patterns 44*a* and 44*c* will ultimately reside on the outside surface 34 of the shoe cover 20. It will be further understood that the traction patterns, such as 40 and 40', may also be applied to both sides, 46 and 46' of the material 42 so that both the inside surface 32 and the outside surface 34 of the shoe cover 20 will be provided with a traction pattern.

Figure 3:
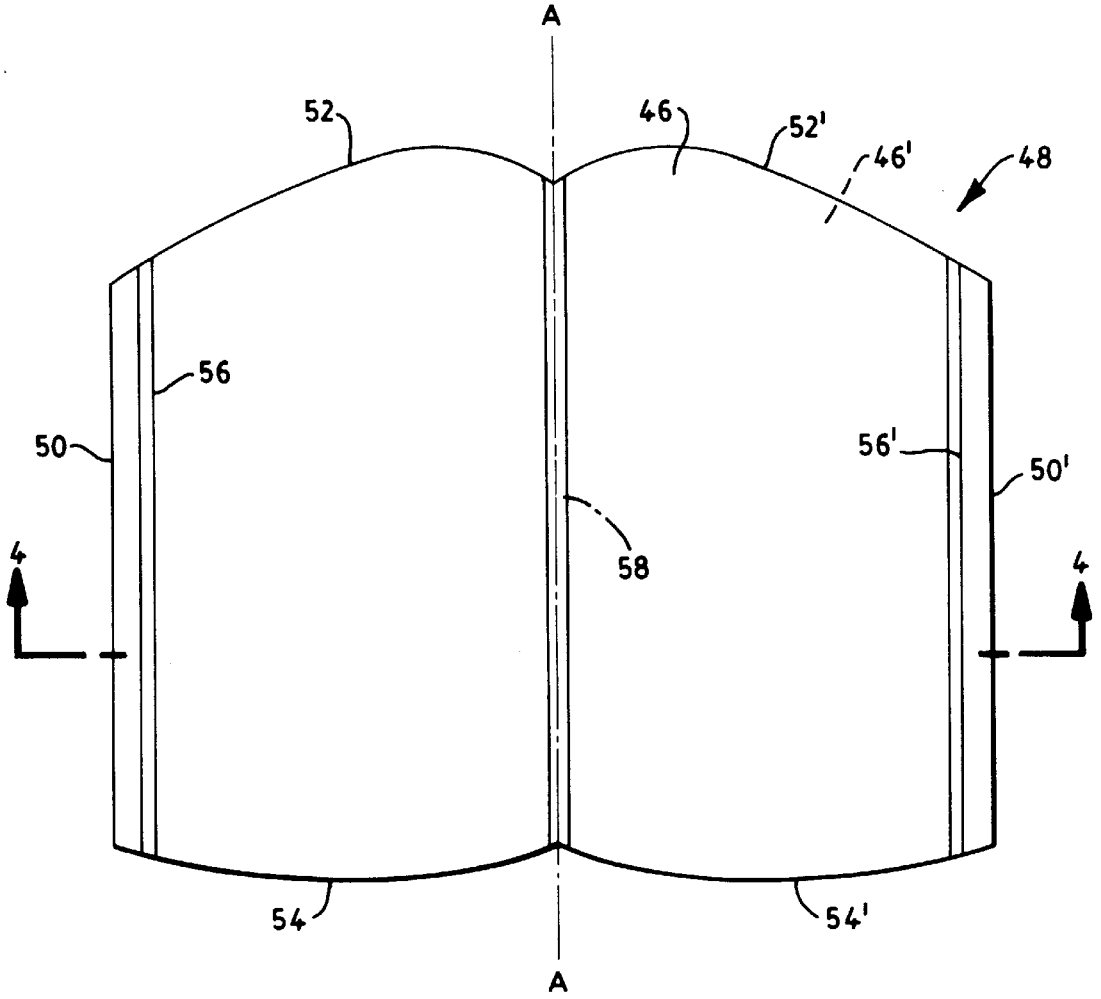
FIG. 3 is a plan view of a shoe cover blank formed in accordance with the cut-out pattern illustrated in FIG. 2.
Figure 4:
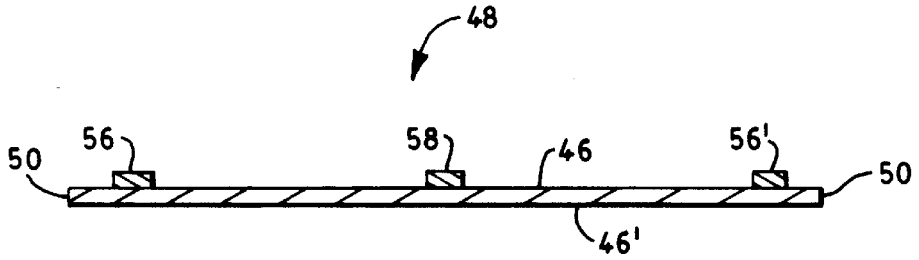
FIG. 4 is a cross-sectional view of the shoe cover blank illustrated in FIG. 3 taken along lines 4—4.

Referring now to FIGS. 3 and 4, there is illustrated a shoe cover blank 48 formed by removing a portion of the material 42 along the shoe cover cut-out pattern 44*b*. So that other structures may be more clearly illustrated, the traction pattern 40' is not illustrated in FIG. 3. The shoe cover blank 48 includes generally parallel edges 50 and 50' and edge pairs 52 and 52' and 54 and 54'. Elastic members 56 and 56', such as an elastic strips, are each secured generally parallel to and near the respective edges 50 and 50' of the shoe cover blank 48. Another elastic member 58, such as and elastic strip, is secured generally along and or parallel the center (illustrated by center line A—A) of the shoe cover blank 48. The center line A—A will ultimately form the bottom edge 24 of the shoe cover 20. The edges 52 and 52' will ultimately form the side edge 26 of the shoe cover 20 when the edges 52 and 52' are aligned and united. Similarly, the edges 54 and 54' will ultimately form the side edge 28 of the shoe cover 20 when the edges 54 and 54' are aligned and united.

The elastic members 56, 56' and 58 may be formed from a variety of elastic materials such as, for example, natural or synthetic rubber, and polyester ether. Desirably, the elastic members 56, 56' and 58 are formed from thermoplastic polyurethane film. Such thermoplastic polyurethane film is available from J. P. Stevens, catalogue no. MP-1882. The dimension of these elastic members may be from between 1 to 20 mils thick and from between ¼ inch to ¾ inch in width.

When the shoe cover blank 48 is formed from a polyolefin nonwoven material, such as a polypropylene nonwoven, desirably the elastic members 56 and 56' may be secured to the nonwoven material by ultrasonic bonding and the elastic member 58 may be secured to the nonwoven material by use of an adhesive. By use of ultrasonics and adhesives to bond these and other components of the shoe cover 20, perforating, which inherently occurs when using a sewing needle, of the shoe cover 20 material is avoided. Desirably, the adhesives used to secure the elastic members to the shoe cover 20 may be an elastic adhesive. An example of a commercially available elastic adhesive is Findley Adhesive Company's (Milwaukee, Wis.) catalogue no. H2096.

Desirably, the elastic members 56, 56' and 58 are tensioned, such as be stretching in the length dimension, prior to being secured to the shoe cover blank 48 or material 42. As such, it may be desirable to sufficiently tension the shoe cover blank 48 or a length of the material 42, such that the shoe cover blank 48 or the material 42 is prevented from contracting once the tensioned elastic members 56, 56' and 58 are secured thereto. As such, it will be understood that it may be desirable not to completely remove individual shoe cover blanks 48 from the material 42 if "in line" or continuous manufacture of the shoe covers 20 is desired until all or substantially all of the process steps illustrated in FIGS. 2–8 have been completed.

Figure 5:
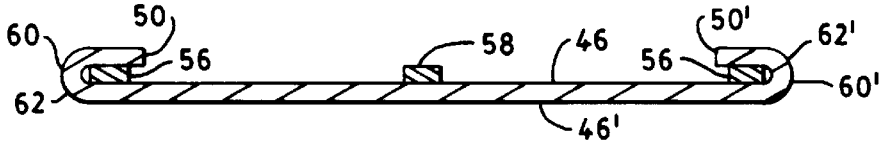
FIG. 5 is a cross-sectional view of FIG. 6 taken along lines 5—5.
Figure 6:
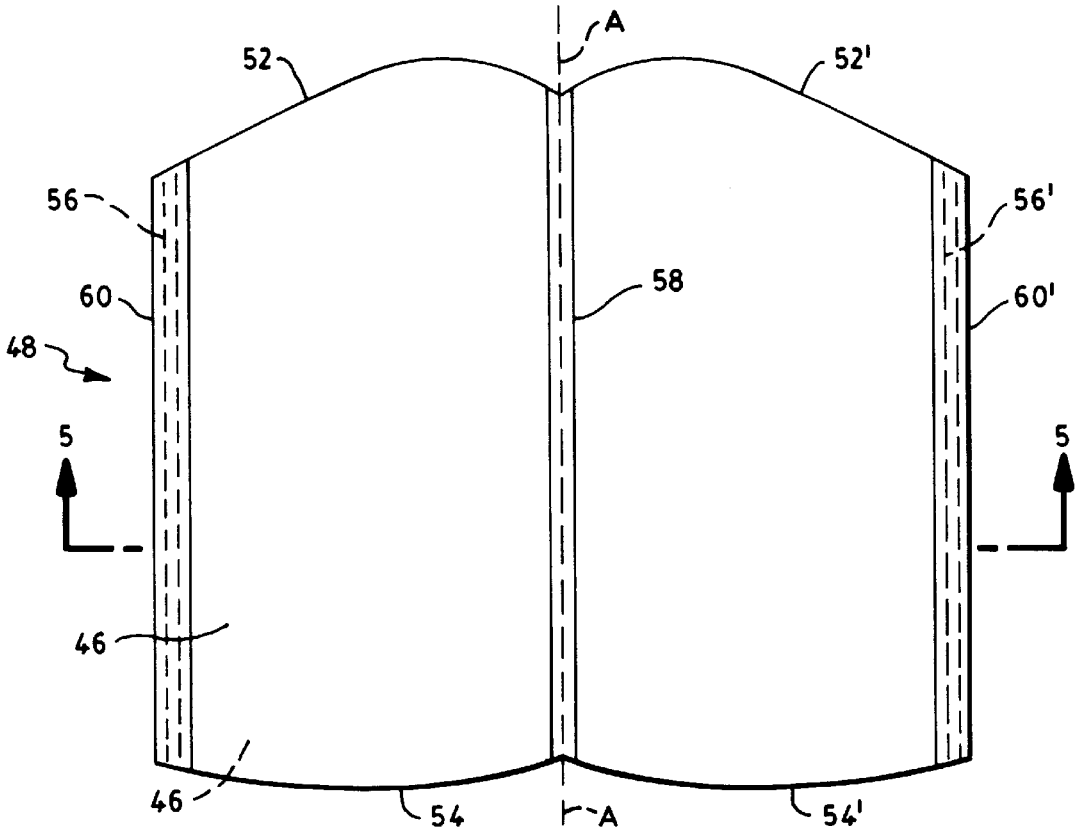
FIG. 6 is another plan view of the shoe cover blank.

Referring now to FIGS. 5 and 6, edges 60 and 60' are formed by folding portions of the shoe cover blank 48 near the edges 50 and 50', respectively, over the elastic members 56 and 56'. By folding the shoe cover blank 48 as just described and illustrated, two three-layered structure 62 and 62' are formed. Each three-layered structure 62 and 62' includes a shoe cover blank layer, an elastic layer, and another shoe cover blank layer (shoe cover/elastic/shoe cover).

It will be further noted that the edges 50 and 50' extend beyond the elastic members 56 and 56'. The edges 60 and 60' will ultimately form the top edges 22 and 22', respectively, of the shoe cover 20. Once the elastic members 56 and 56' are overlaid by a portion of the shoe cover blank 48 as previously described and illustrated, it may be desirable to secure the three-layered structures, 62 and 62' by ultrasonic bonding. It may be further desirable that the three layered structures, 62 and 62', be ultra sonicly bonded over their entire length as opposed to spot bonding along the lengths thereof.

Figure 7:
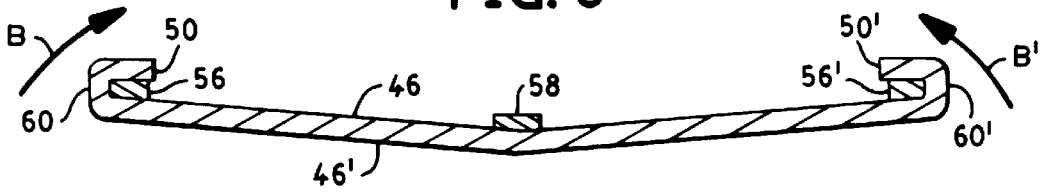
FIG. 7 is a cross-sectional view of the shoe cover blank taken along lines 5—5 of FIG. 6 illustrating a folding step in the process of forming the shoe cover.
Figure 8:
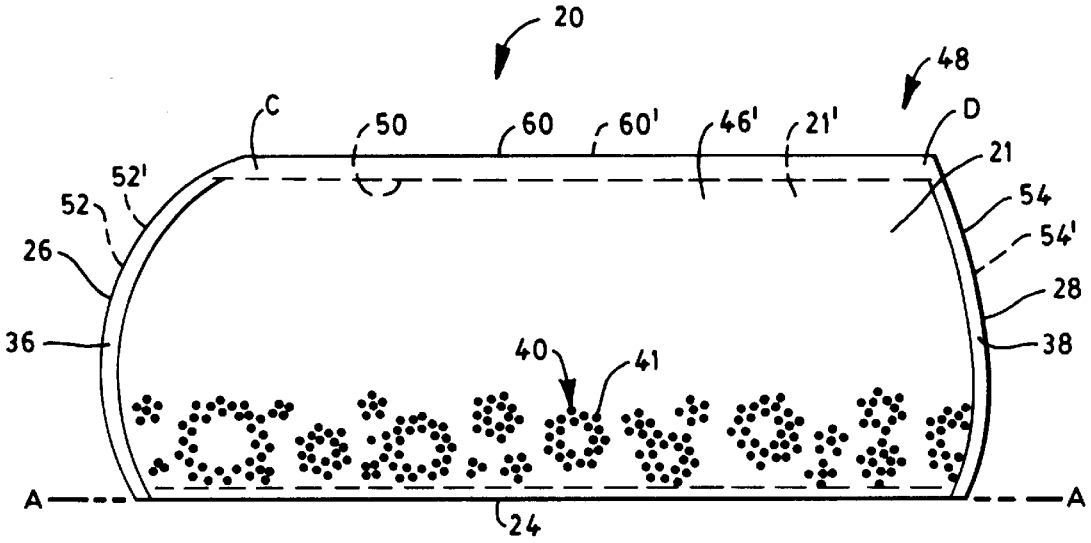
FIG. 8 is a side plan view of a folded shoe cover blank folded in accordance with the folding step illustrated in FIG. 7.

Referring now to FIG. 7 and FIG. 8 (now illustrating the traction pattern 40), the shoe cover blank 48 (illustrated in FIGS. 5 and 6) is folded along the center line A—A (FIGS. 6 and 8) in a direction indicated by arrows B and B' in FIG. 7 such that edges 60 and 60', 52 and 52' and 54 and 54' generally align so as to form the panels 21 and 21'. Aligning edges 52 and 52' forms the side edge 26 and aligning edges 54 and 54' forms the side edge 28. The bottom edge 24 is formed by folding the shoe cover blank 48 along the center line A—A.

A portion of the panels 21 and 21', illustrated by the reference letter C, are secured at generally the intersection of edges 60, 60' and with edges 52 and 52' by the application of a pressure sensitive hot melt adhesive. Desirably, the pressure sensitive hot melt adhesive may be applied by spraying. It will be understood that the dimension of the spray pattern of the hot melt adhesive applied to the portion C may vary. However, it has been found that a spray pattern of hot melt adhesive having a width at least sufficient to overly the material between edges 60 and 50 or 60' and 50' (FIG. 7), and a length of about ½" to about 1", extending from the edge pair 52/52' towards edge pair 54/54' to be sufficient.

The panels 21 and 21' may be further secured by ultrasonically bonding the portions of the edges 52 and 52' between the pressure sensitive hot melt adhesive and the bottom edge 24. The width and length of the seam 36 formed by ultrasonic bonding may be varied by methods and techniques well known to those skilled in the art. It is desirably that the material bonded by the hot melt adhesive not be exposed to the ultrasonic bonding. In this way, over-bonding the hot melt adhesive by ultrasonic bonding is avoided. In those instances when the hot melt adhesive is applied first followed by ultrasonic bonding, it has been observed that a stronger bond is created, and particularly, when the shoe cover material formed from nonwoven polypropylene, when the hot melt adhesive is not over-bonded by ultrasonic bonding as opposed to over-bonding the hot melt adhesive with ultrasonic bonding. However, ultrasonic bonding followed by over-bonding with the hot melt adhesive sufficiently bonds such materials.

A portion of the panels 21 and 21', illustrated by the reference letter D are secured at generally the intersection of edges 60, 60' and with edges 54 and 54' by the application of a pressure sensitive hot melt adhesive. Desirably, the pressure sensitive hot melt adhesive may be applied by spraying. It will be understood that the dimension of the spray pattern of hot melt adhesive may vary. However, it has been found that a spray pattern of hot melt adhesive having a width at least sufficient to overly the material between edges 60 and 50 or 60' and 50' (FIG. 7), and a length of about ½" to about 1", extending from the edge pair 54/54' towards the edge pair 52/52' to be sufficient.

The panels 21 and 21' may be further secured by ultrasonically bonding the portions of the edges 54 and 54' between the pressure sensitive hot melt adhesive and the bottom edge 24. As previously mentioned, the width and length of the seam 38 formed by ultrasonic bonding may be varied by methods and techniques well known to those skilled in the art. Similarly, for the reason stated above, it is desirably that the material bonded by the hot melt adhesive not be exposed to the ultrasonic bonding.

Furthermore, as previously mentioned, it is desirable that the traction pattern not extend into the area of the panels 21 and 21' which are ultrasonically bonded. Such areas include, for example, seams 36 and 38. Extending the traction pattern into these areas may result in fowling or damaging the ultrasonic bonding equipment by the material used for forming the traction pattern.

After securing the panels 21 and 21' as described above the shoe covers 20 may be rolled in pairs and stored for future use. It will be understood by those skilled in the art that all of the above described steps in the process of forming the shoe cover 20 may be preformed in an "in-line" or continuous manner.

Figure 9:
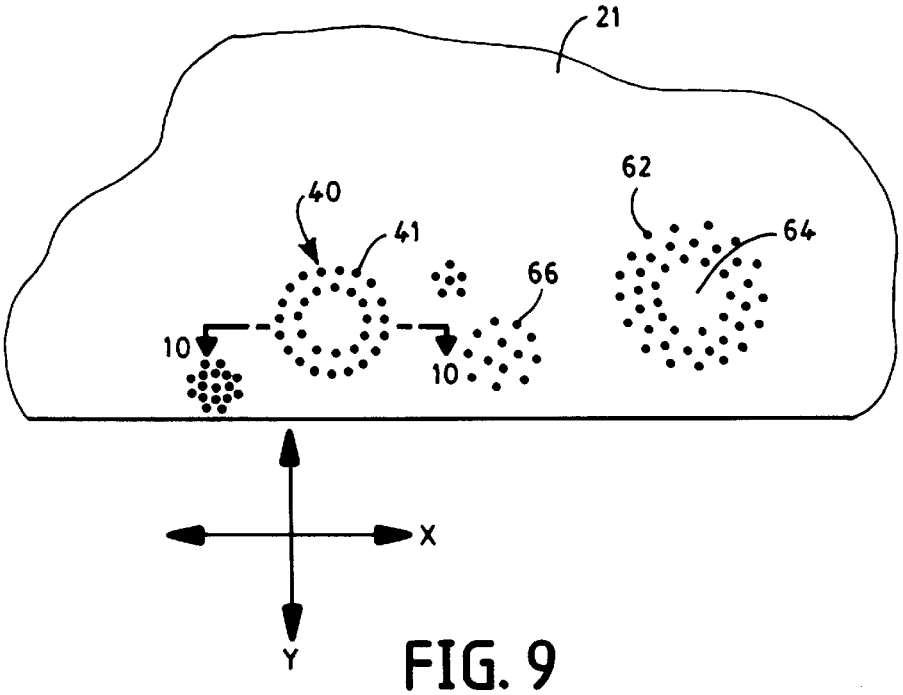
FIG. 9 is an enlarged view of a portion of the shoe cover of FIG. 8 illustrating a portion of the shoe cover and a cleat pattern.

Referring now to FIG. 9, a portion of the traction pattern 40 illustrated in FIG. 8 has been enlarged for clarity of illustration. The traction pattern 40 includes a plurality of individual and separate cleats 41. While the traction pattern 40 illustrated in FIGS. 8 and 9 may generally be described as a series of repeating circles, it will be understood that other traction patterns formed by a plurality of cleats 41 may be suitable for purposes of the present invention and will be readily appreciated by those skilled in the art. It will be further observed that some of the individual circles, such as for example the circle 62, forming the traction pattern 40 have no cleats 41 in the center 64. On the other hand, the center of other circles, such as for example the circle 66, are generally occupied by one or more of the cleats 41.

Figure 10:
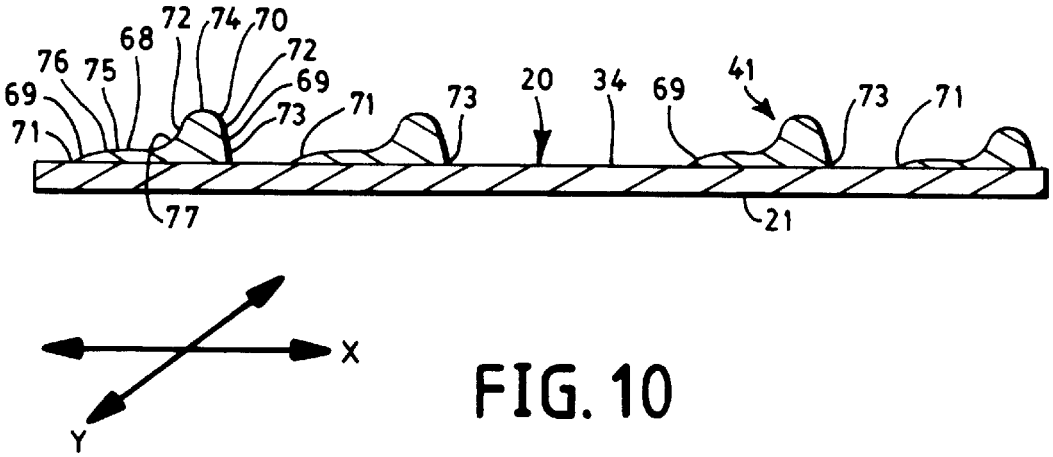
FIG. 10 is a cross-sectional view of a portion of the shoe cover taken along lines 10—10 of FIG. 9 illustrating the cross-sectional profile of several cleats.
Figure 11:
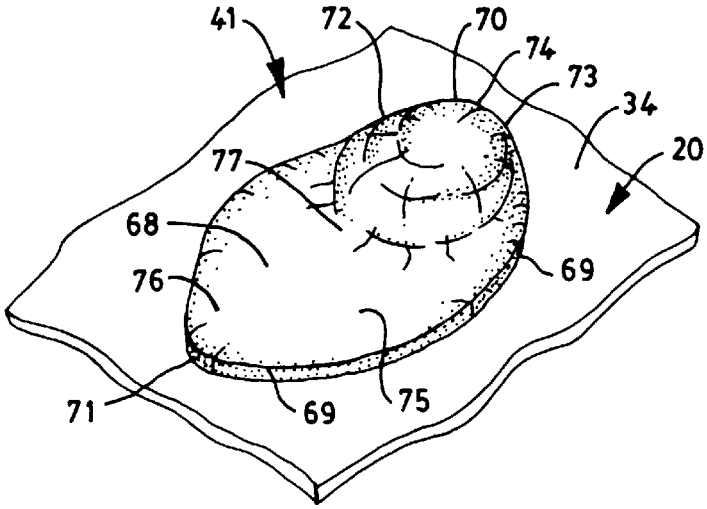
FIG. 11 is an enlarged perspective view of one of the cleats illustrated in FIG. 10.

Referring now to FIGS. 10 and 11, FIG. 10 shows an enlarged cross-sectional portion of the traction pattern 40 illustrated in FIG. 9 and further illustrates several cleats 41 in cross section. FIG. 11 is an enlarged perspective view of one of the cleats 41. The cleats 41 are generally oval-shaped. However, it will be understood that the cleats 41 may be formed into other shapes, such as circular, elliptical, rod-shaped, rectangular, square, trapezoid and the like. It will be further understood that the traction pattern 40 may be formed from one or more of such cleats 41 shapes.

Referring now to FIG. 10, in cross-section, the cleats 41 may generally be described as some what "foot-shaped" with a thinned "toe" portion extending from a first end 71 along a surface 75 of the cleat 41 towards a thicken "ankle" portion. The ankle portion then terminating at a "heel" portion or second end 73. The cleats 41 may also be generally described as "L" shaped in cross-section. The cleats 41 may also be described as having a first portion 68, corresponding to the "toe" portion, and a second portion 70, corresponding to the "ankle/heel" portion. The first portion 68 and the second portion 70 are eccentricly positioned. The second portion 70 is thicker in cross-section than the first portion 68 and desirably, the thickest point of the second portion 70 is at least twice as thick as the thickest point of the first portion 68.

The first portion 68 includes side walls 69 which extend from the surface of shoe cover 20, such as the outside surface 34. While the thickness of the first portion 68 may vary, the first portion 68 may further be generally described as planar when viewed by the human eye unassisted by magnification. The second portion 70 may further be generally described as dome-shaped and includes side walls 72 which extend from the first portion 68 to an apex 74.

The transition from the first portion 68 to the second portion 70 of the cleat 41 may generally be described as seamless or continuous. More particularly, the transition from the first portion 68 to the second portion 70 is perceptible, by both sight and touch, along the area of the cleat 41 between the first end 71 to the apex 74. This is so because of the change in the slope of the surface 75 from the first portion 68 to the second portion 70 of the cleat 41 in an area generally indicated by reference number 77. However, the transition from the second portion 70 to the first portion 68 in the area of the cleat 41 between the apex 74 and the second end 73 is generally imperceptible, by both sight and touch. This is so because there is little if any change in the slop between the side wall 72 of the second portion 70 and the side wall 69 of the first portion 68 between the apex 74 and the second end 73 (FIG. 10).

With continued reference to FIG. 10, the cleats 41 may generally be selectively arranged within the traction pattern 40. One such arrangement of the cleats 41 may generally be described as a "heel-toe" arrangement. In other words, for example, when viewing the cleats 41 along the x-axis in FIG. 10, the second end 73 of one cleat 41 is nearer the first end 71 of a following cleat 41 than the second end 73 of said following cleat 41.

The eccentric positioning of the first and second portions, 70 and 72, respectively in combination with the flexibility of the material forming the shoe cover 20, described in greater below, provides the cleat 41 with at least two contacting surfaces for contacting a support structure, such as a floor, when the shoe cover 20 is worn. The contacting surfaces of the cleats 41 may, for example, contact a floor, such as an operating room floor, or the sole of the wearer's shoe, depending upon whether the cleat 41 is secured to the outside surface 34 or the inside surface 32 of the shoe cover 20 or both.

The first contacting surface of the cleat 41 is generally in the area of and may include the apex 74. The second contacting surface of the cleat 41 is in an area of the first portion 68 generally illustrated by reference numeral 76. The area 76 is generally spaced a distance from the second portion 70. It will also be appreciated that the cleats 41 may be sufficiently spaced apart on the surface of the shoe cover 20 such that the surface of the shoe cover 20 between the cleats 41 may contact a supporting structure, such as a floor, when the cleat 41 is in contact with such supporting structure. Alternatively, the cleats 41 may be sufficiently spaced apart on the surface of the shoe cover 20 such that the surface of the shoe cover 20 between the cleats 41 does not contact a supporting structure, such as a floor, when the cleat 41 is in contact with such supporting structure.

The cleats 41 and the traction pattern 40 may be selectively printed on to one or more of the surfaces of the shoe cover 20. Desirable, the cleats 41 and traction pattern 40 are printed on the shoe cover by the gravure process or screen printer, both of which are well known by those skilled in the art. Particularly, the gravure process may desirably be preformed on a printing apparatus of the kind manufactured by the ITW Dynatech Company of Hendersonville, Tenn. It will be further understood that the print wheel of such a printing apparatus may be fitted with various patterns. As such, various traction patterns and cleat dimensions may be achieved by varying the print wheel pattern, the speed of the print wheel and/or the line speed or entry speed of the shoe cover material at the print wheel.

When the cleats 41 are formed by printing, it is desirable that the cleat forming material be a hot melt material. Suitable examples of cleat forming material include: Swift 84-123 or 84-193 which are formed from vinyl acetate and paraffin wax and are products of Swift adhesives, a Division of Reichhold Chemicals, Inc. of Illinois and Findley's catalogue no. 222-237 or 795-334 which are also vinyl acetate based hot melt materials.

The shoe cover 20 may be formed from a variety of fabrics such as woven and nonwoven fabrics. Polymers are well suited for the formation of fabrics, both woven and nonwoven, which are useful in the practice of the present invention. Nonwoven fabrics can be made from a variety of processes including, but not limited to, air laying processes, wet laid processes, hydroentangling processes, spunbonding, meltblowing, staple fiber carding and bonding, and solution spinning. The fibers themselves can be made from a variety of dielectric materials including, but not limited to, polyesters, polyolefins, nylons and copolymers of these materials. The fibers may be relatively short, staple length fibers, typically less than 3 inches, or longer more continuous fibers such as are typically produced by a spunbonding process.

The fabrics of the present invention may be formed from a single layer or multiple layers. In the case of multiple layers, the layers are generally positions in a juxtaposed or surface-to-surface relationship and all or a portion of the layers may be bound to adjacent layers.

It has been found that nonwoven fabrics formed from thermoplastic based fibers and desirable polyolefin-based fibers are well-suited for the above applications. Examples of such fibers include spunbond fibers and meltblown fibers. Examples of such nonwoven fabrics formed from such fibers are the polypropylene nonwoven fabrics produced by the Assignee of record, Kimberly-Clark Corporation.

In one embodiment, the nonwoven laminate may include at least one ply formed from spunbond fibers and another ply formed from meltblown fibers, such as a spunbond/meltblown (SM) nonwoven laminate. In another embodiment, the nonwoven laminate may include at least one ply formed from meltblown fibers which is positioned between two plies formed from spunbond fibers, such as a spunbond/meltblown/spunbond (SMS) nonwoven laminate. Examples of these nonwoven laminates are disclosed in U.S. Pat. No. 4,041,203 to Brock et al., U.S. Pat. No. 5,169,706 to Collier, et al, and U.S. Pat. No. 4,374,888 to Bornslaeger which are all herein incorporated by reference. It should be noted, however, that materials other than nonwovens may be used. Examples of such other materials include wovens, films, foam/film laminates and combinations hereof, with and without nonwovens, may be used in the present invention, such as for example a spunbond/film/spunbond (SFS) laminate.

The spunbond fibers may be formed from polypropylene. Suitable polypropylene for the spunbond layers are commercially available as PD-9355 from the Exxon Chemical Company of Baytown, Tex.

The meltblown fibers may be formed from polyolefin polymers, such as polypropylene and polybutylene or a blend thereof. Examples of such meltblown fibers are contained in U.S. Pat. Nos. 5,165,979 and 5,204,174 which are incorporated herein by reference. Desirably, the meltblown fibers may be formed from a blend of polypropylene and polybutylene wherein the polybutylene is present in the blend in a range from 0.5 to 20 weight percent of the blend. One such suitable polypropylene is designated 3746-G from the Exxon Chemical Co., Baytown, Tex. One such suitable polybutylene is available as DP-8911 from the Shell Chemical Company of Houston, Tex. The meltblown fibers may also contain a polypropylene modified according to U.S. Pat. No. 5,213,881 which is incorporated herein by reference.

The SMS nonwoven laminate may be made by sequentially depositing onto a moving forming belt first a spunbond ply, then a meltblown ply and last another spunbond ply and then bonding the plies together to form the laminate. Alternatively, the plies may be made individually, collected in rolls, and combined in a separate bonding step. Such SMS nonwoven laminates usually have a basis weight of from about 0.1 to 12 ounces per square yard (osy) (3 to 400 grams per square meter (gsm)), or more desirably from about 0.75 to about 5 osy (25 to 170 gsm) and still more desirably from about 0.75 to about 3 osy (25 to 100 gsm).

While the invention has been described in detail with respect to specific embodiments thereof, it will be appreciated that those skilled in the art, upon attaining an understanding of the foregoing, may readily conceive of alterations to, variations of and equivalents to these embodiments.

Accordingly, the scope of the present invention should be assessed as that of the appended claims and any equivalents thereto.

What is claimed is:

1. A shoe cover having portions thereof defining an opening and adapted to receive a sole of a shoe, the shoe cover comprising:

a body having an elastic member secured to an inside surface of the body and adapted to contact the sole; and cleats secured to an outside surface of the body, wherein at least one cleat is adapted to overlie the sole, wherein said at least one cleat includes a first raised portion connected to a second raised portion, said second raised portion being thicker in cross-section than said first raised portion, wherein each of said first and second raised portions are positioned to both contact an adjacent surface when said shoe cover is being worn.

2. The shoe cover of claim 1 wherein the first and second raised portions are eccentrically positioned with respect to each other.

3. A shoe cover of claim 1, wherein said first raised portion of said at least one cleat is substantially planar and said second raised portion is dome-shaped.

4. The shoe cover of claim 1, wherein all of said cleats include a first raised portion connected to a second raised portion, said cleats being sequentially positioned on said outside surface of said body such that a second raised portion of a first cleat is located adjacent to a first raised portion of a following cleat along an axis of said shoe cover.

5. The shoe cover of claim 1, wherein said body is made from a nonwoven material.

6. A disposable, flexible shoe cover having portions thereof defining an opening, the shoe cover comprising:

cleats secured to an outside surface of the shoe cover, wherein at least one cleat includes a first raised portion connected to a second raised portion, said second raised portion being thicker in cross-section than said first raised portion, wherein each of said first and second raised portions are positioned to both contact an adjacent surface when said shoe cover is being worn.

7. The shoe cover of claim 6, wherein the first and second raised portions are eccentrically positioned with respect to each other.

8. The shoe cover of claim 6 having an elastic member secured to an inside surface of the shoe cover, wherein the elastic member is adapted to contact a sole received within said opening.

9. A shoe cover of claim 7, wherein said first raised portion of said at least one cleat is substantially planar and said second raised portion is dome-shaped.

10. The shoe cover of claim 7, wherein all of said cleats include a first raised portion connected to a second raised portion, said cleats being sequentially positioned on said outside surface of said body such that a second raised portion of a first cleat is located adjacent to a first raised portion of a following cleat along an axis of said shoe cover.

11. A shoe cover having portions thereof defining an opening and adapted to receive a sole of a shoe, the shoe cover comprising:

a pair of panels secured near an area defined by respective top and side edges with a pressure sensitive hot melt adhesive, and wherein portions of the respective side edges between the pressure sensitive hot melt adhesive and a bottom edge are ultrasonically bonded together, the shoe cover further including cleats secured to an outside surface of the shoe cover, some of the cleats being adapted to overlie the sole, wherein at least one cleat includes a first raised portion and a second raised portion, the second raised portion being thicker in cross-section than the first raised portion, wherein each of said first and second raised portions are positioned to both contact an adjacent surface when said shoe cover is being worn.

12. The shoe cover of claim 11 wherein the first and second raised portions are eccentrically positioned with respect to each other.

13. A shoe cover of claim 11, wherein said first raised portion of said at least one cleat is substantially planar and said second raised portion is dome-shaped.

14. The shoe cover of claim 11, wherein all of said cleats include a first raised portion connected to a second raised portion, said cleats being sequentially positioned on said outside surface of said body such that a second raised portion of a first cleat is located adjacent to a first raised portion of a following cleat along an axis of said shoe cover.

15. A shoe cover having portions thereof defining an opening and adapted to receive a sole of a shoe, the shoe cover comprising:

a pair of panels secured near an area defined by respective top edges and side edges with a pressure sensitive hot melt adhesive, and wherein portions of the respective side edges between the pressure sensitive hot melt adhesive and a bottom edge are ultrasonically bonded together;

an elastic member ultrasonically bonded to each panel near the top edge thereof and another elastic member secured near the bottom edge of one of the panels, and wherein a portion of the top edges of each panel defines the opening;

cleats secured to an outside surface of at least one panel, wherein some of the cleats are adapted to overlie the sole, and wherein the cleats include a first raised portion and a second raised portion, the second raised portion being thicker in cross-section than the first portion, wherein each of said first and second raised portions are positioned to both contact an adjacent surface when said shoe cover is being worn, and wherein the first and second portions are eccentrically positioned with respect to each other.

* * * * *